United States Patent [19]

Robinson

[11] Patent Number: 4,561,616

[45] Date of Patent: Dec. 31, 1985

[54] BRACKET ASSEMBLY FOR INVERTING GUTTER TO DUMP ACCUMULATED DEBRIS

[76] Inventor: Genevieve T. Robinson, 499 Millbrook Rd., Devon, Pa. 19333

[21] Appl. No.: 625,854

[22] Filed: Jun. 27, 1984

[51] Int. Cl.[4] ..... E04D 13/06

[52] U.S. Cl. ..... 248/48.2

[58] Field of Search ..... 248/48.2, 48.1; 52/11; 16/361, 360

[56] References Cited

U.S. PATENT DOCUMENTS

| | | | |
|---|---|---|---|
| 950,386 | 2/1910 | Giles | 16/361 |
| 984,716 | 2/1911 | Swisher | 248/48.1 |
| 2,244,182 | 6/1941 | Allen | 16/360 |
| 3,341,158 | 9/1967 | Landis | 248/48.2 |
| 3,630,473 | 12/1971 | Landis | 248/48.2 |
| 4,309,792 | 1/1982 | Faye | 248/48.2 |
| 4,311,292 | 1/1982 | Deason | 248/48.2 |

*Primary Examiner*—Reinaldo P. Machado
*Assistant Examiner*—Alvin Chin-Shue
*Attorney, Agent, or Firm*—Laurence R. Brown

[57] ABSTRACT

A bracket assembly for attachment to a building for mounting a gutter allows the gutter to be inverted for dumping accumulated debris. Two parallel bracket members are latched together closely adjacent to the mounting wall. One bracket member pivots outwardly when the two members are unlatched to empty debris from the gutter. The gutter when inverted is directed at an angle away from the longitudinal axis of the mounting wall to direct dumped debris away from the mounting wall. The latch comprises a hook latched by vertical movement of the pivotable bracket member about the pivot axis. Structure for latching and unlatching from ground level is provided by a cable pulley arrangement for vertically moving the pivotable latch member.

3 Claims, 3 Drawing Figures

BRACKET ASSEMBLY FOR INVERTING GUTTER TO DUMP ACCUMULATED DEBRIS

TECHNICAL FIELD

This invention relates to a bracket assembly for mounting a gutter on a building and more particularly it relates to a bracket assembly for inverting the gutter to dump accumulated debris.

BACKGROUND ART

Cleaning gutters of accumulated debris is necessary to insure that the gutters function property. Cleaning the gutter when it is in its normal upright position is difficult. Manually cleaning the gutter by climbing on the roof of a building presents a safety risk for the individual as well as potential damage to the roof. It is not easy to clean the gutter from the ground because of accessibility and possible damage to the gutter structure. Inverting the gutter to dump the accumulated debris overcomes these problems. Prior art devices, for example, Deason—U.S. Pat. No. 4,311,292 and Faye—U.S. Pat. No. 4,309,792 provide means for inverting gutters. These known prior art devices invert the gutter by rotating a modified gutter having a pivot mechanism about a pivoting point on a special bracket assembly horizontally extending away from the vertical mounting wall. The gutter is rotated less than 180 degrees to invert the gutter to empty accumulated debris. However, this tends to dump the debris against the mounting wall and deface its surface.

Furthermore, if a gutter needs replacing, the special gutter with pivot mechanism need be custom built at high expense. It is thus highly desirable to mount standard gutter assemblies, to facilitate replacement and repair.

In addition, latches afforded in the prior art for pivotable gutters have not provided positive latching and dumping mechanisms that could be easily manipulated from ground level. Thus, it may be necessary to climb up to the gutter height to release the latching mechanism and pivot the gutter. Also, the latches may not be of the locking type which avoid accidental pivoting of the gutter when not planned.

Thus, it is an objective of this invention to provide improved pivotable gutter assemblies resolving the foregoing prior art deficiencies. Other objects, features and advantages are found throughout the following description, drawings and claims.

SUMMARY OF THE INVENTION

The bracket assembly provided by this invention has two adjacent parallel members, one affixed to the vertical mounting wall and the other pivoted thereto about a lowermost pivoting point closely adjacent to the vertical mounting wall. This allows the gutter when inverted to be directed at an angle away from the vertical mounting wall to direct the accumulated debris away from the wall, thereby preventing damage to the surface of the mounting wall.

The movable brackets receive a standard inexpensive gutter assembly, since the pivoting mechanism is in the brackets.

A latch comprises a simple U-shaped flange at the top of the pivoting bracket member that mates over a receptacle notch on the bracket member fixed on the wall. Vertical movement to lock and unlock the latch is provided by a slotted cavity about a pivot pin extending through the pivot axis. This latch when the gutter becomes filled more securely holds the brackets in locked position by means of the weighted gutter.

To manipulate the gutter from ground level, a pull cord extends over a pulley behind the bracket fixed on the wall and engages the pivotable bracket to vertically displace it by means of the slotted cavity riding over the pivot pin, so that the latch flange is raised above the locking position. When the gutter carries debris, it will cause a rotation of the pivoted bracket about the pivot pin and move the lower corner of the gutter against the vertical wall with the open gutter top directed outwardly at an angle to keep the debris off the wall when the gutter is emptied.

DETAILED DESCRIPTION OF THE PREFERRED EMBODIMENT

Figure 1:
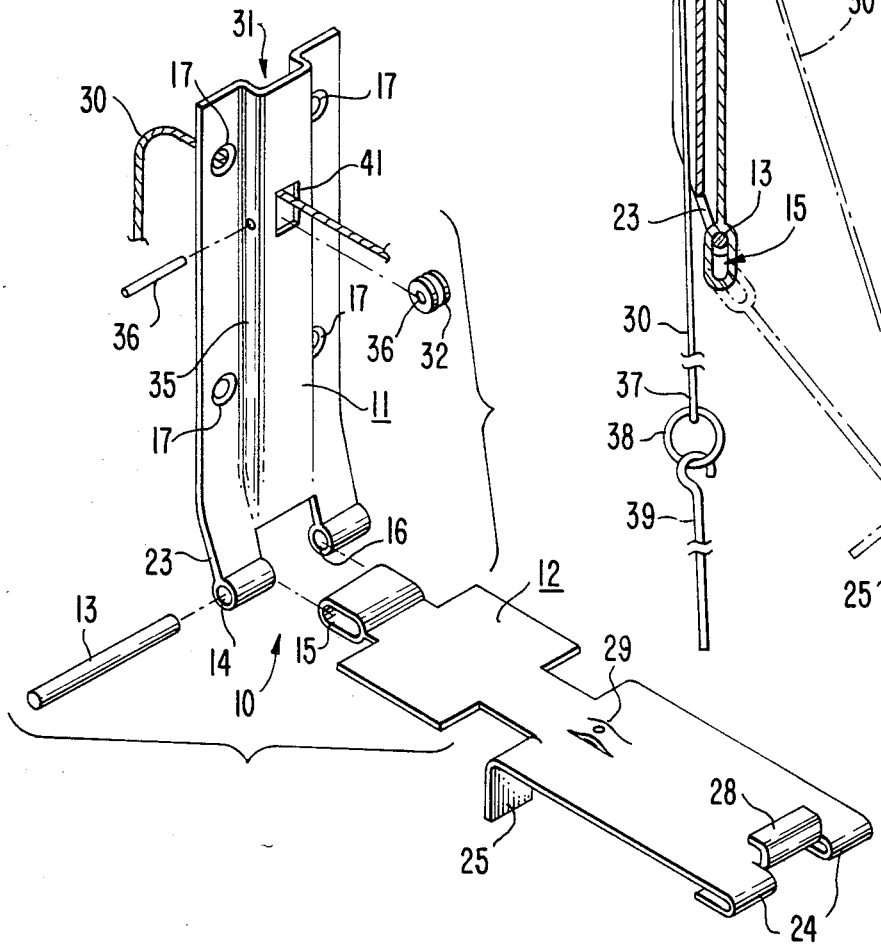
FIG. 1 is an exploded disassembled perspective view of a pivotable bracket assembly for emptying gutters embodying the invention.
Figure 3:
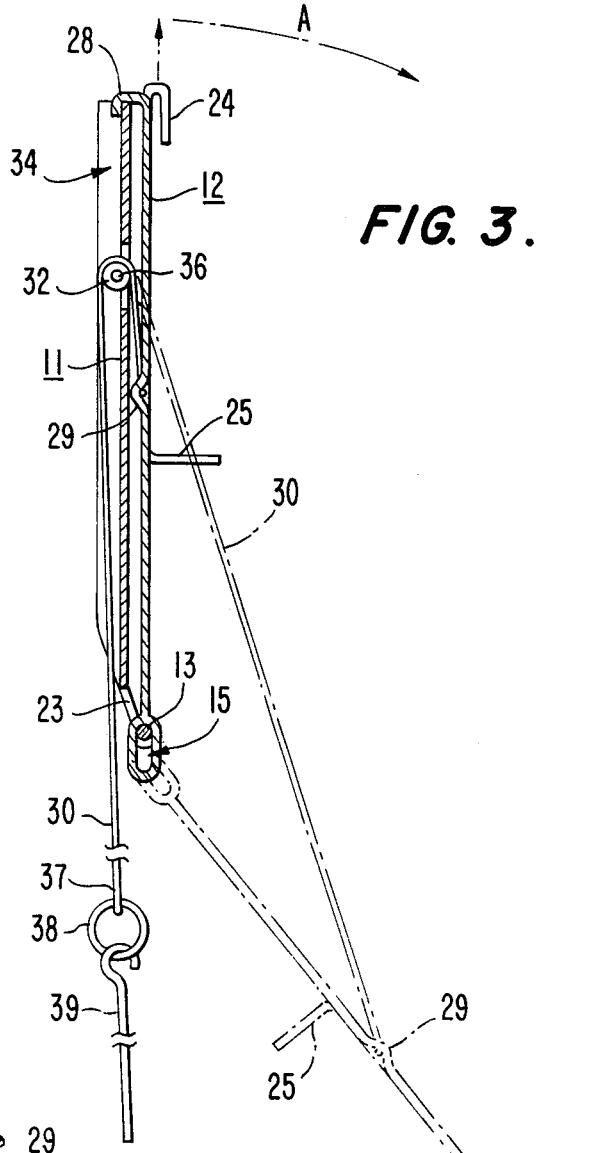
FIG. 3 is an end section view of the bracket assembly illustrating the pulley system afforded by the invention for operating the latching mechanism from ground level.

As may be seen in FIGS. 1 and 3, the bracket assembly 10 is comprised of a first bracket member 11 pivotally attached to a second bracket member 12. The first bracket member 11 is attached to a building 19 having a vertical mounting wall to which a gutter 21 may be mounted to receive water from the building roof 22. The first fixed bracket member 11 includes a plurality of fastening means openings 17 for mounting the first bracket member 11 to the vertical mounting wall 18. The fastening means such as screws 20 are inserted through openings 17 into the mounting wall 18. The lowermost terminal end 23 of the first bracket member 11 is angled away from the longitudinal axis of the mounting wall 18 and includes cylindrical cavities 14 and 16 for receiving pivot pin 13.

The pivotable bracket member 12 includes an oval slot 15, hinged about pivot pin 13, for pivotally attaching said second bracket member 12 to said first bracket member. The oval slot 15 vertically slides on pivot rod 13 to permit enough vertical movement of said second bracket member 12 to latch and unlatch the brackets, as later described.

The pivotable bracket member 12 is adapted to receive the gutter thereon by means of a gutter retaining system including retaining lips 24 for locking over a top gutter edge and support means comprising short lips or tabs 25 for resting under the bottom surface of the gutter. Thus, the gutter 21 is mounted on the bracket assembly 10 by resting the gutter 21 on the tabs 25 with the retaining lips 24 clamped over the back wall 26 of the gutter 21 adjacent the house 19.

The pivotable bracket member 12 is pivotally attached to said first bracket member 11 for pivotal movement about an axis closely adjacent to the vertical mounting wall 18 to maintain the bracket 12 parallel to and closely adjacent to the fixed bracket member 11 and to the mounting wall 18 when the gutter 21 is held in its normal water receiving position under the edge of roof 22 of the building 19.

Figure 2:
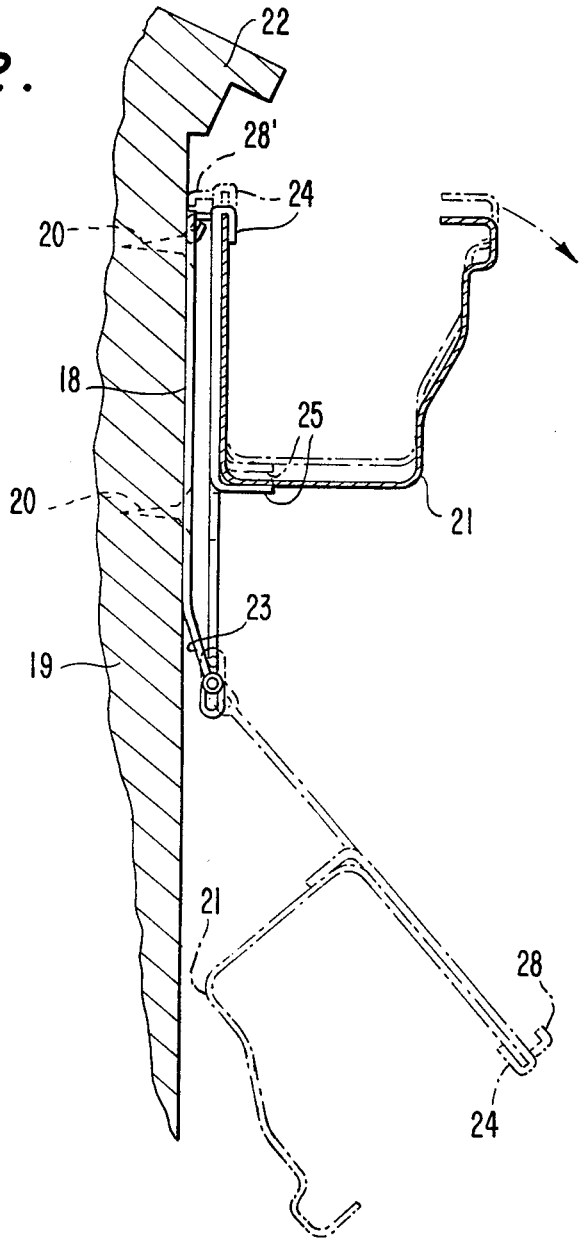
FIG. 2 is an end view in section of the bracket assembly attached to a building wall fragmentally illustrated, with a phantom view of the gutter in its inverted debris discharge position.

As shown in FIG. 3, the two bracket members 11 and 12 are latched together by a manually actuable interacting latch structure operable from ground level. The latch means comprising hook 28 disposed on the pivotable bracket member 12 and latch catch 31 disposed on the fixed bracket member 11 are shown engaged in latched position (FIGS. 2, 3) for maintaining the gutter 21 in the normal water receiving position. The oval slot 15 provides sufficient vertical movement to allow the latch hook 28 of the pivotable bracket member 12 to be raised up for release from or latch over the latch catch edge of notch 31 of the fixed bracket member 11. When released, the pivotable bracket member 12 with the gutter 21 mounted thereon pivots downward along an arc to invert the gutter 21 as shown in phantom view. The gutter 21 is rotated less than 180 degrees as evident from FIG. 2. This allows the accumulated debris to be directed away from the mounting wall.

The bracket assembly 10 may be operated from ground level. The latch hook 28 is mated by a pulley system in this embodiment. Thus, pulley cable 30 is passed around a pulley wheel 32 mounted in bracket member opening 39 (FIG. 1) by pin 36 passing through pulley wheel 32. One end of said pulley cable 30 is attached to a protruding member 29 of the pivotable bracket member 12. The opposite end 37 of the cable may have a ring 38 for receiving the pole hook 39 manually manipulated from ground level. Thus, pulling downwardly on ring 38 raises pivotable bracket member 12 upward to release the latch hook 28 from the latch catch over the fixed bracket member 11. The cable 30 could extend downward along and parallel to the mounting wall to allow a user standing on the ground to invert the gutter and return it to its water receiving position for manual operation without pole hook 39.

The gutter on pivotable axis pin 13 will tend to rotate about its arc because of the center of gravity, whenever slack is permitted in cable 30 as the unlatching position is reached. However, note that the position 31 of the pulley wheel will allow pulling the pivotable member 12 toward the mounting wall and fixed bracket 11 when the cable is taut and thus will lift the pivotable bracket 12 vertically to engage latch hook 28.

I claim:

1. A bracket assembly for attachment to a building wall for mounting a standard open top gutter thereon in a movable position for selective manual pivoting away from a positive latched position for receiving water from the building roof to allow the gutter to be inverted and directed away from the wall for dumping accumulated debris away from the wall, comprising in combination, a first bracket member for fixed attachment to a building having a vertical gutter mounting wall for mounting the gutter in place for receiving water from the building roof, a second bracket member vertically movable alongside and pivotally attached to said first bracket member for relative rotation thereon over an arc having thereon retaining structure to lock in place and support thereon the gutter to pivot therewith, pivoting means connecting the two brackets pivotably about an axis closely adjacent to the building wall allowing the two bracket members to be maintained substantially parallel and closely adjacent to the building wall when the gutter is positioned to receive water from the roof while permitting the gutter and second bracket member to move vertically and to pivot through an arc of less than 180 degrees with the gutter reaching a limiting position in contact with the building wall and directed outwardly to direct accumulated debris away from the wall, and said first and second bracket members defining respectively thereon manually actuable interacting hook and latch members for engagement and disengagement upon vertical movement of the second bracket, said members maintaining the gutter locked in place in a water receiving position with said first and second bracket members parallel to and adjacent to the building wall in a latched position and for releasing said second bracket member from said first bracket member by means of vertical movement of the second bracket member to permit pivoting of the gutter downward about said arc to invert the gutter open top to said direction directed away from the wall for dumping accumulated debris therefrom.

2. A bracket assembly as defined in claim 1 having a latch assembly comprising a flanged U-shaped hook on the uppermost edge of the second pivotable bracket member positioned for engaging in locking position a mating receptacle notch on the first bracket member by means of vertical movement of the hook over the mating notch to hold the hook in place by the weight of the gutter.

3. A bracket assembly as defined in claim 2 including a ground level operable pulley system attached to said second pivotable bracket member for vertically moving said pivotable member for releasing said latch structure and pivoting the second bracket member whereby the gutter is inverted to discharge debris.

* * * * *